US010010224B2

(12) United States Patent
Pelfrey

(10) Patent No.: US 10,010,224 B2
(45) Date of Patent: Jul. 3, 2018

(54) VARIABLE OUTPUT PUMP FOR FOAM DISPENSING SYSTEM

(71) Applicant: GOJO Industries, Inc., Akron, OH (US)

(72) Inventor: Keith A. Pelfrey, Wadsworth, OH (US)

(73) Assignee: GOJO Industries, Inc., Akron, OH (US)

( * ) Notice: Subject to any disclaimer, the term of this patent is extended or adjusted under 35 U.S.C. 154(b) by 72 days.

(21) Appl. No.: 15/005,053

(22) Filed: Jan. 25, 2016

(65) Prior Publication Data

US 2016/0213203 A1 Jul. 28, 2016

Related U.S. Application Data

(60) Provisional application No. 62/107,774, filed on Jan. 26, 2015.

(51) Int. Cl.

| | |
|---|---|
| ***B65D 37/00*** | (2006.01) |
| ***A47K 5/14*** | (2006.01) |
| ***B05B 7/24*** | (2006.01) |
| ***B05B 7/04*** | (2006.01) |
| ***A47K 5/12*** | (2006.01) |
| ***B05B 7/00*** | (2006.01) |

(Continued)

(52) U.S. Cl.

CPC ..... *A47K 5/14* (2013.01); *A47K 5/1208* (2013.01); *A47K 5/1209* (2013.01); *A47K 5/1211* (2013.01); *A47K 5/16* (2013.01); *B05B 7/005* (2013.01); *B05B 7/0416* (2013.01); *B05B 7/24* (2013.01); *B05B 9/0872* (2013.01); *F04B 43/1269* (2013.01); *A47K 5/1215* (2013.01)

(58) Field of Classification Search

CPC ..... A47K 5/14; A47K 5/1208; A47K 5/1209; A47K 5/1211; A47K 5/16; A47K 5/1215; B05B 7/005; B05B 7/0416; B05B 7/24; B05B 9/0872; F04B 43/1269; F04B 43/12; F04B 43/08; F04B 43/1284; F04B 43/1253

USPC ..... 222/214

See application file for complete search history.

(56) References Cited

U.S. PATENT DOCUMENTS 4,735,558 A * 4/1988 Kienholz ..... F04B 43/1284 417/477.2

4,921,150 A * 5/1990 Lagergren ..... A47K 5/1215 137/624.11

(Continued)

FOREIGN PATENT DOCUMENTS

EP 2614518 A1 11/1988

EP 2135538 A1 12/2009

OTHER PUBLICATIONS

"Plate" Merriam-Webster.com. Merriam-Webster, Oct. 2017.*

*Primary Examiner* — Benjamin R Shaw

(74) *Attorney, Agent, or Firm* — Calfee, Halter & Griswold LLP

(57) ABSTRACT

An exemplary refill unit for a foam dispenser includes a container for holding foamable liquid and a liquid pump. The liquid pump includes a pump housing and an outlet nozzle with an elongated central axis. The pump housing has an arcuate shaped liquid pump chamber formed by a backing plate. The backing plate includes a liquid inlet and a flexible membrane. At least a portion of the elongated central axis of the nozzle extends through a central area defined, at least in part, by the arcuate shaped pump chamber.

14 Claims, 7 Drawing Sheets

(51) Int. Cl.

| | |
|---|---|
| ***A47K 5/16*** | (2006.01) |
| ***B05B 9/08*** | (2006.01) |
| ***F04B 43/12*** | (2006.01) |

(56) References Cited

U.S. PATENT DOCUMENTS

2004/0007590 A1* 1/2004 Hedington ..... A61J 1/10 222/105
2004/0228735 A1* 11/2004 Byrne ..... F04B 43/1253 417/53
2005/0247737 A1* 11/2005 Armstrong ..... A47K 5/1202 222/214
2008/0203591 A1* 8/2008 Pelfrey ..... A47K 5/16 261/28
2009/0294477 A1* 12/2009 Ciavarella ..... A47K 5/1208 222/190
2010/0286651 A1* 11/2010 Sorensen ..... A61M 1/0058 604/500
2012/0014824 A1* 1/2012 Han De Man ..... A47K 5/1208 417/472
2012/0111891 A1* 5/2012 McNulty ..... A47K 5/1208 222/181.3
2012/0111895 A1* 5/2012 Fitzpatrick ..... A47K 5/1209 222/214
2012/0248149 A1* 10/2012 Pelfrey ..... B67D 1/108 222/214
2013/0206794 A1 8/2013 McNulty
2013/0262345 A1* 10/2013 Ciavarella ..... A61L 2/0088 705/500
2014/0103972 A1 4/2014 Pelfrey
2014/0124540 A1* 5/2014 Ciavarella ..... A47K 5/14 222/190
2014/0263464 A1* 9/2014 Corney ..... A47K 5/1204 222/207
2014/0356205 A1* 12/2014 Baxter ..... F04B 43/1276 417/477.7

* cited by examiner

VARIABLE OUTPUT PUMP FOR FOAM DISPENSING SYSTEM

CROSS REFERENCE TO RELATED APPLICATIONS

This non-provisional utility patent application claims priority to and the benefits of U.S. Provisional Patent Application Ser. No. 62/107,774 filed on Jan. 26, 2015 and entitled VARIABLE OUTPUT PUMP FOR FOAM DISPENSING SYSTEM, which is incorporated herein by reference in its entirety.

TECHNICAL FIELD

The present invention relates generally to dispensing systems, such as liquid or foam soap and sanitizer dispensers.

BACKGROUND OF THE INVENTION

Dispensing systems, such as liquid or foam soap and sanitizer dispensers, provide a user with a predetermined amount of liquid or foam upon actuation of the dispenser.

SUMMARY

Exemplary embodiments of dispensers, refill units, and pumps with variable output are disclosed herein.

In one exemplary embodiment, an exemplary refill unit for a foam dispenser includes a container for holding foamable liquid and a liquid pump. The liquid pump includes a pump housing and an outlet nozzle with an elongated central axis. The pump housing has an arcuate shaped liquid pump chamber formed by a backing plate. The backing plate includes a liquid inlet and a flexible membrane. At least a portion of the elongated central axis of the nozzle extends through a central area defined, at least in part, by the arcuate shaped pump chamber

BRIEF DESCRIPTION OF THE DRAWINGS

These and other features and advantages of the present invention will become better understood with regard to the following description and accompanying drawings in which.

DETAILED DESCRIPTION

Figure 1:
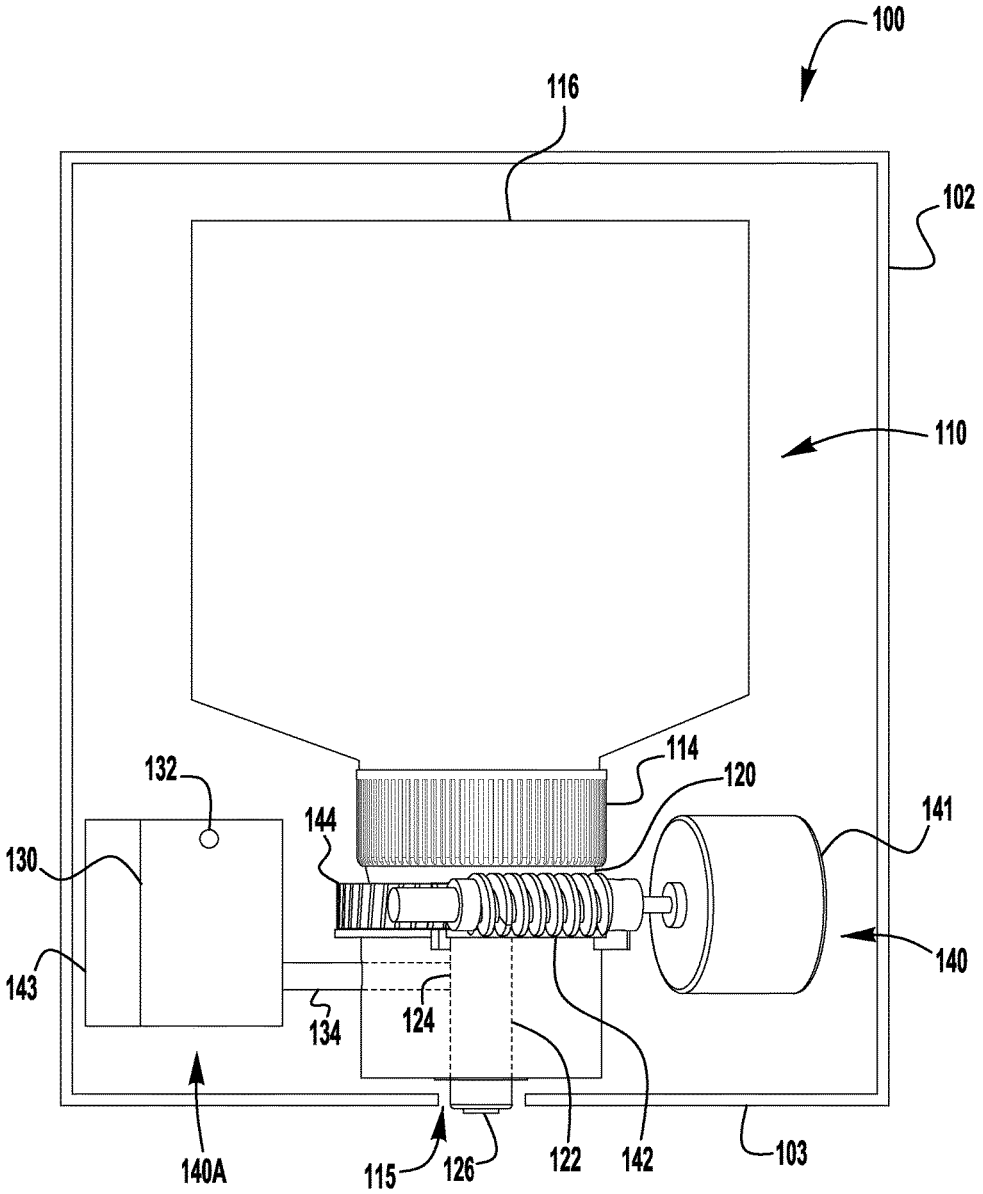
FIG. 1 is a cross-section of an exemplary dispenser having a refill unit.

FIG. 1 illustrates an exemplary embodiment of a foam dispenser 100. The cross-section of FIG. 1 is taken through the housing 102 to show a liquid pump 120, an air pump 130, a container 116, and an actuator 140. The dispenser 100 includes a disposable refill unit 110. The disposable refill unit 110 comprises the container 116 and liquid pump 120. The dispenser 100 may be a wall-mounted system, a counter-mounted system, an un-mounted portable system movable from place to place, or any other kind of dispenser system. The dispenser 100 can be configured to pump liquid only with the air pump 130 removed or deactivated.

The container 116 forms a liquid reservoir that contains a supply of dispensable liquid within the disposable refill unit 110. In various embodiments, the contained liquid could be for example a soap, a sanitizer, a cleanser, a disinfectant, a foamable liquid, or some other dispensable liquid. In the exemplary disposable refill unit 110, the container 116 is a collapsible container and can be made of thin plastic or a flexible bag-like material. In other embodiments, the container 116 may be formed by a rigid housing member, or have any other suitable configuration for containing the liquid without leaking. A rigid container may include a vent (not shown) to vent the container.

The container 116 may advantageously be refillable, replaceable or both refillable and replaceable. In the event the liquid stored in the container 116 of the installed disposable refill unit 110 runs out, or the installed refill unit 110 otherwise has a failure, the installed refill unit 110 may be removed from the dispenser 100. The empty or failed disposable refill unit 110 may then be replaced with a new disposable refill unit 110.

The refill unit 110 includes the liquid pump 120 that is in fluid communication with the container 116. A collar 114 secures the liquid pump 120 to the container 116. The collar 114 may secure the liquid pump 120 to the container 116 by any means, such as, for example, a threaded connection, a welded connection, a quarter turn connection, a snap fit connection, a clamp connection, a flange and fastener connection, or the like. The liquid pump 120 includes a premix chamber 122 that has an air inlet 124 to receive air from the air pump 130 through an air delivery tube 134. The premix chamber 122 is connected to an outlet nozzle 126. In one embodiment, the liquid pump 120, premix chamber 122, and outlet nozzle 126 are part of the refill unit 110 and may be disposed of upon depletion of the liquid from the container 116. In the same embodiment, the air pump 130 and air delivery tube 134 are secured to the dispenser 100 and are not disposed of while replacing the refill unit 110. The concept of having a foam pump that has a liquid pump portion separable from an air pump portion may be referred to as a "split pump."

The air pump 130 is generically illustrated because there are many different kinds of air pumps which may be employed in dispenser 100. Air pump 130 may be any type of air pump, such as a rotary pump, a piston pump, a fan pump, a turbine pump, a pancake pump, a diaphragm pump, or the like.

In one embodiment, the refill unit 110 includes projections (not shown) that interface with a rotatable retention ring (not shown) on the interior of the housing 102. These projections retain the liquid pump 120 in contact with an actuation assembly 144 of actuator 140 when the refill unit 110 is installed in the dispenser 100. The refill unit 110 may be secured within the dispenser 100 by any other means, such as, for example, a quarter turn connection, a threaded connection, a flange and fastener connection, a clamped connection, or any other releasable connection. In some embodiments, components of the actuator 140, such as actuation assembly 144, may be part of the refill unit 110. In fact, many of the components of the actuator 140 may be part of the dispenser 100 or be part of the refill unit 110.

During operation of the dispenser 100, foamable liquid is pumped from the container 116 by the liquid pump 120 into the premix chamber 122. Simultaneously, air is drawn into the air pump 130 through an air inlet 132 and is pumped through the air delivery tube 134 into the air inlet 124 of the premix chamber 122 to mix with the liquid. The air and liquid mixture is then forced through foaming media (not shown) to dispense rich foam from the nozzle 126. In one embodiment, foaming media includes one or more screens that generate high quality foam. Foaming media may also include porous members, sponges, baffles, or the like. An aperture 115 in a bottom plate 103 of the housing 102 allows foam dispensed from the nozzle 126 to exit the housing 102 for use by the user.

The dispenser 100 contains one or more actuators 140 to activate the liquid pump 120 and the air pump 130. As used herein, actuator, actuating members, or mechanism includes one or more parts that cause the dispenser 100 to move liquid, air or foam. Different actuators 140, 140A may activate the liquid pump 120 and air pump 130, or one actuator may be used to activate both the liquid pump 120 and air pump 130. In one embodiment of the dispenser 100, the actuator 140 comprises an electric motor 141 that turns a drive train 142 (such as the worm gear shown) that interfaces with the actuation assembly 144 that actuates the liquid pump 120 when turned. The electric motor 141 of actuator 140 may be an AC motor or a DC motor and may be powered by a standard electrical source, such as 115 VAC or by batteries. A second motor 143 of the actuator 140A activates the air pump 130 to pump air into the premix chamber 122 to generate foam. Although the actuators 140, 140A are shown as the electric motors 141, 143, they may be any kind of actuator capable of activating the liquid pump 120 and air pump 130, such as a manual lever, a manual pull bar, a manual push bar, a manual rotatable crank, an electrically activated actuator, or other means for actuating the liquid pump 120 and air pump 130. Electronic actuators may additionally include a sensor (not shown) to provide for a hands-free dispenser system with touchless operation.

The air pump 130 and actuators 140, 140A may be connected to the housing 102 by any means, such as a threaded connection, a welded connection, an adhesive connection, or the like. In one particular split pump embodiment, the electronics (not shown), air pump 130, air delivery tube 134, and actuators 140, 140A are attached to a pump housing module (not show) that is attached to the housing 102. Assembling these components into the pump housing module allows for easier assembly of the dispenser 100, possibly with a robotic assembly device, and ensures alignment of the components. The air pump 130, air delivery tube 134, and actuators 140, 140A may be attached to the pump housing module by any means, such as a threaded connection, a welded connection, an adhesive connection, a snap fit connection, a friction fit connection, or the like. While a snap fit connection is suitable for attaching the pump module to the housing 102, the assembled pump module may be attached to the housing 102 by any means, such as a threaded connection, a welded connection, an adhesive connection, a friction fit connection, or the like.

Figure 2:
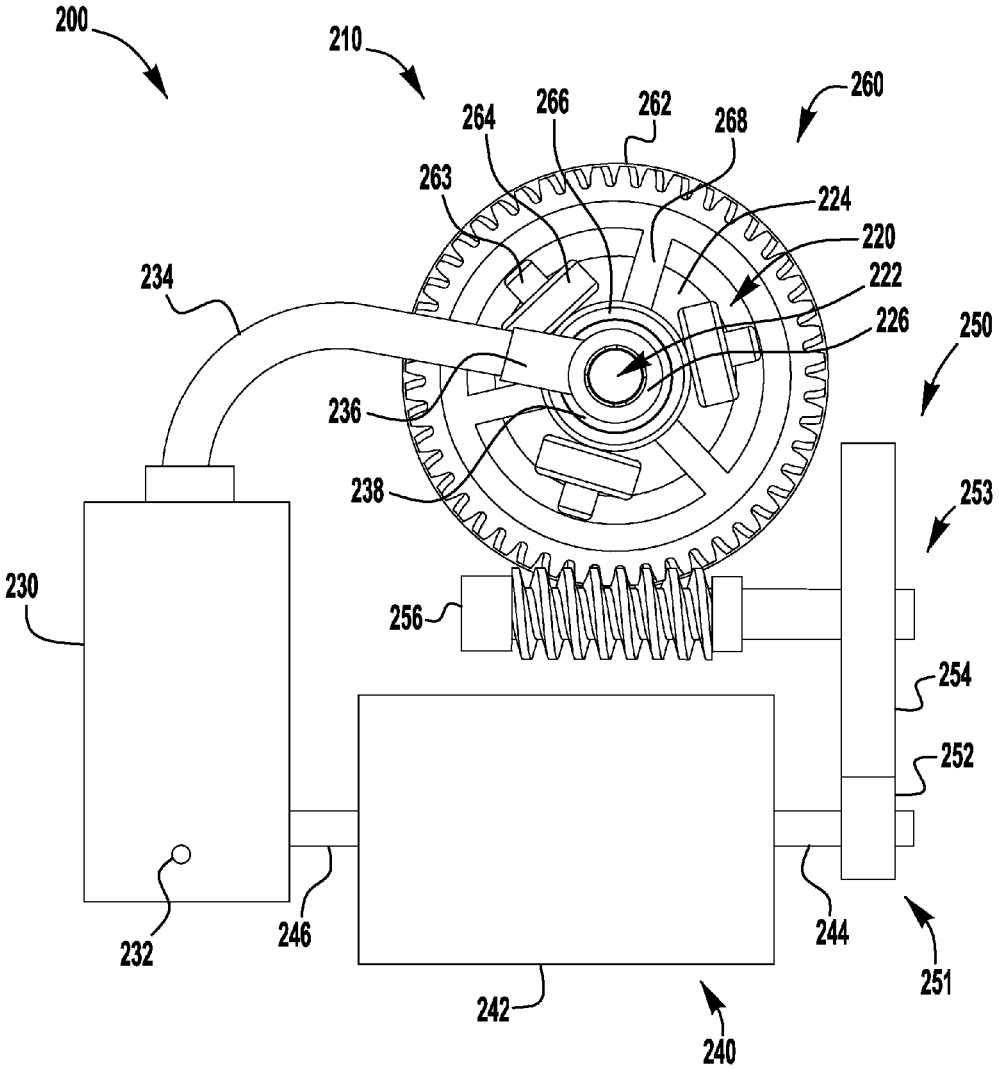
FIG. 2 is a schematic diagram illustrating the actuation mechanism for an exemplary dispenser having an air compressor and refill unit having a liquid pump inserted therein.

FIG. 2 illustrates an exemplary embodiment of a foam dispenser 200 that includes a liquid pump 220, which is part of a refill unit that is removable from the dispenser, and an air pump 230 in a split pump configuration, and an actuator 240 driven by a motor 242. The actuator 240 includes a gear train 250 and an actuation assembly 260. The view in FIG. 2 is from below the dispenser, looking up at the liquid pump 220, air pump 230, and actuator 240.

In the illustrated embodiment, the motor 242 of actuator 240 is an electric motor that includes two shafts that rotate at the same speed and in the same direction when power is provided to the motor 242. Electric motor 242 may be an AC motor or a DC motor and may be powered by a standard electrical source, such as 115 VAC outlets or by batteries. A liquid pump drive shaft 244 provides power to the actuation assembly 260 and an air pump drive shaft 246 provides power to the air pump 230.

The gear train 250 includes a first gear 252, a second gear 254, and a third gear 256. The first gear 252 is coaxial with the liquid pump drive shaft 244 of motor 242, forming a first gear assembly 251. The second gear 254 is coaxial with the third gear 256, forming a second gear assembly 253. The axes of rotation of the first and second gear assemblies 251, 253 may be parallel or non-parallel. If the axes are non-parallel, they may then be intersecting or non-intersecting. It will be understood by one skilled in the art that different gear types may be used for different arrangements of the axes of rotation. For example, bevel gears may be used if the axes are non-parallel and intersecting, while hypoid gears may be used if the axes are non-parallel and non-intersecting. In the illustrated embodiment, the axes of the first and second gear assemblies 251, 253 are parallel. In this arrangement, the first and second gears 252, 253 may be spur, helical, or herringbone gears, or any other suitable pairing of gears.

The gear train 250 transmits power from the motor 242 to the actuation assembly 260, and also reduces the rotational speed of the motor 242 so that more than one rotation of the liquid pump drive shaft 244 is required to rotate the actuation assembly 260 through a complete rotation. The second gear 254 is larger in diameter than the first gear 252 so that multiple rotations of the first gear 252 are needed to turn the second gear 254 once, thus reducing the rotational speed of the motor 242 as it is transmitted to the actuation assembly 260. The third gear 256 is a worm gear which also requires multiple turns to rotate the actuation assembly 260 once, further reducing the rotational speed transmitted from the motor 242 to the actuation assembly 260.

The actuation assembly 260 includes a drive gear 262 that interfaces with the third gear 256 of the drive train 250. A central hub 266 is connected to the drive gear 262 by at least one spoke 268, and at least one pump roller 264 is disposed in the space between the central hub 266 and the drive gear 262. The rollers 264 are rotatably assembled to both the drive gear 262 and the central hub 266 on steel pins (not shown). Each roller 264 includes a spacer 263 that holds the rollers 264 in the position required to actuate the liquid pump 220.

The liquid pump 220 includes a flexible actuation membrane 224 that encloses a pump chamber (not shown) that forms a horseshoe shaped dome. The pump chamber is in fluid communication with the container (not shown) and with a premix chamber 222. The liquid pump 220 is positioned with respect to the actuation assembly 260 such that the flexible actuation membrane 224 is compressed by the pump rollers 264 as the actuation assembly 260 is rotated. The rollers 264 progressively compress portions of the membrane 224, and therefore the pump chamber, causing the liquid to be drawn into the pump chamber behind the pump rollers 264 and liquid in the pump chamber in front of pump rollers 264 to be forced to flow into the premix chamber 222 in FIG. 3. In some embodiments, when the actuation assembly 260 is not rotated, at least one roller 264 continues to compress the actuation membrane 224, preventing fluid from flowing out of the container (not shown) when the actuator 240 is idle.

The air pump 230 delivers air through an air delivery tube 234 to the premix chamber 222. The air delivery tube 234 connects to premix chamber 222 through an air interface 236. The air interface 236 sealably connects to the premix chamber 222 with a collar 238. The collar 238 allows an air tight connection to be made between the air delivery tube 234 and the premix chamber 222 regardless of the orientation of the refill unit 210 when it is installed in the foam dispenser 200.

As described above, the gear train 250 allows the motor 242 to drive the liquid pump 220 at a lower rotational speed than the air pump 230. Rotating the two pumps at different speeds allows the ratio of the flow rate of air to liquid to be adjusted. In some embodiments, the air pump 230 and the liquid pump 220 have the same volume capacity and the air pump 230 is driven at a speed required to have an air to liquid ratio between about 1 to 1 and about 20 to 1, for example, the air to liquid ratio may be about 15 to 1, 10 to 1, 8 to 1, or 5 to 1. In some embodiments, the volume capacity of the air pump 230 is greater than the volume capacity of the liquid pump 220 so that one revolution of the air pump drive shaft 246 causes the air pump 230 to output a greater volume of air than the amount of liquid pumped by the liquid pump 220 with one revolution of the liquid pump drive shaft 244. Again, the air to liquid ratio may be between about 1 to 1 and about 20 to 1, for example, the air to liquid ratio may be about 15 to 1, 10 to 1, 8 to 1, or 5 to 1. In addition to the embodiments described above, any combination of differential volume capacity and rotational speeds between the two pumps may be used to generate an air to liquid ratio between about 1 to 1 and about 20 to 1, for example, the air to liquid ratio may be about 15 to 1, 10 to 1, 8 to 1, or 5 to 1.

Figure 3:
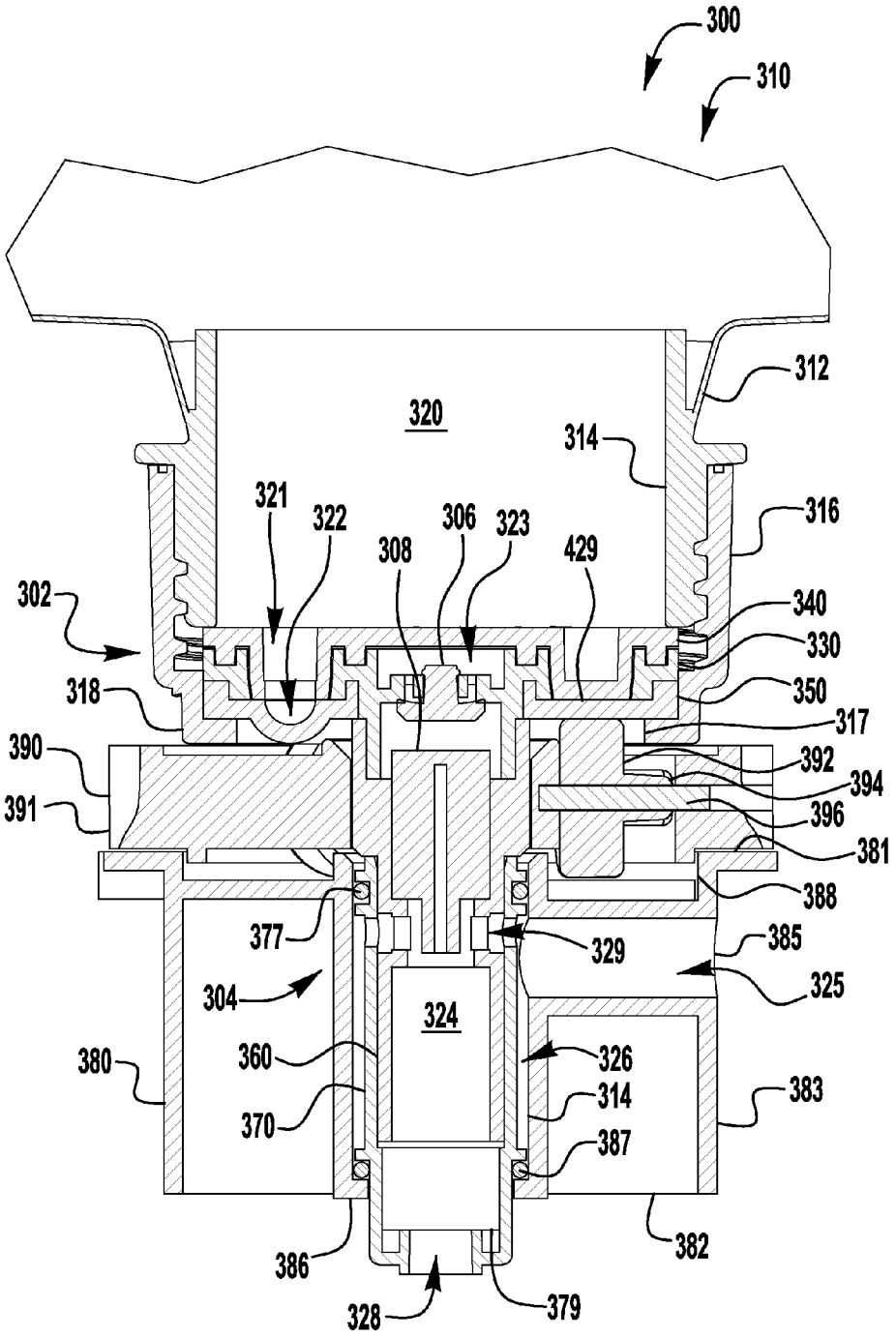
FIG. 3 is a cross-section of a foam pump of an exemplary dispenser and refill unit inserted therein.

Referring now to FIGS. 3-6, an exemplary embodiment of a foam dispenser 300 with a split pump configuration is illustrated. FIG. 3 is a cross-sectional view of the foam dispenser 300 with a refill unit 310 installed. An air pump (not shown) connects to a base 380. An actuation assembly 390 is also included. The refill unit 310 comprises a container 312 (partially shown), a liquid pump 302, and a nozzle assembly 304. The liquid pump 302 comprises a body 330, a back plate 340, and a flexible actuation membrane 350. The nozzle assembly 304 includes a nozzle 360 and a foaming outlet 370, and is assembled to a pump outlet 407 (FIG. 4) of the liquid pump 302.

The interior of the container 312 forms a reservoir 320 for holding foamable liquid. A neck 314 of the container 312 is received within a retaining collar 316. The liquid pump 302 is disposed between a shoulder 318 of the collar 316 and the neck 314 of the container 312. When the collar 316 is connected to the neck 314 of the container 312, a liquid tight seal is formed between the liquid pump 302 and the container 312. An opening 317 in the collar 316 allows access to the actuation membrane 350 of the liquid pump and allows the nozzle assembly 304 to protrude below the collar 316. The collar 316 may be connected to the container 312 by any means, such as, for example, a threaded connection, a welded connection, an adhesive connection, a snap fit connection, a quarter turn connection, or the like.

Figure 4:
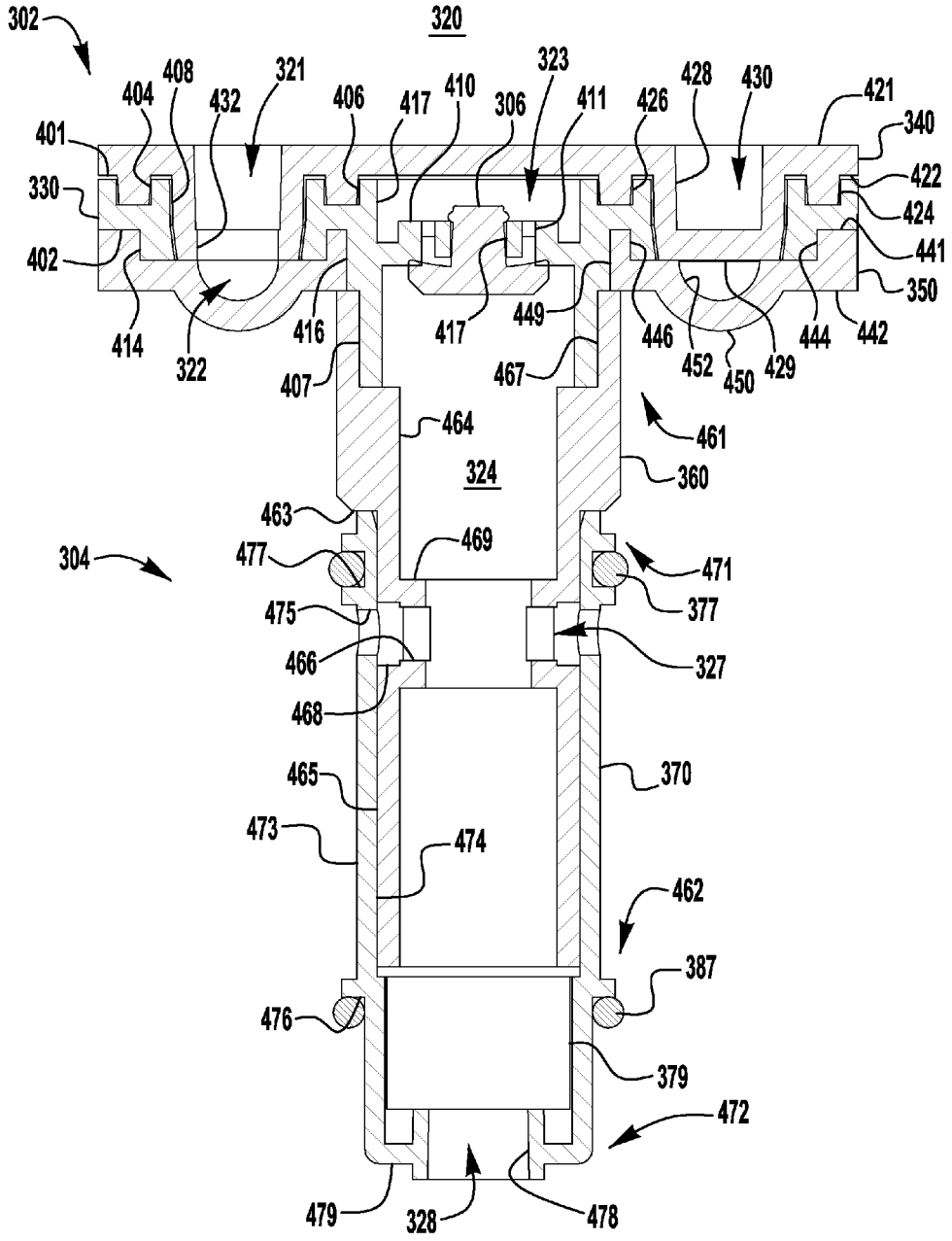
FIG. 4 is an enlarged cross-section of liquid pump 302 and nozzle assembly 304 of FIG. 3.
Figure 5:
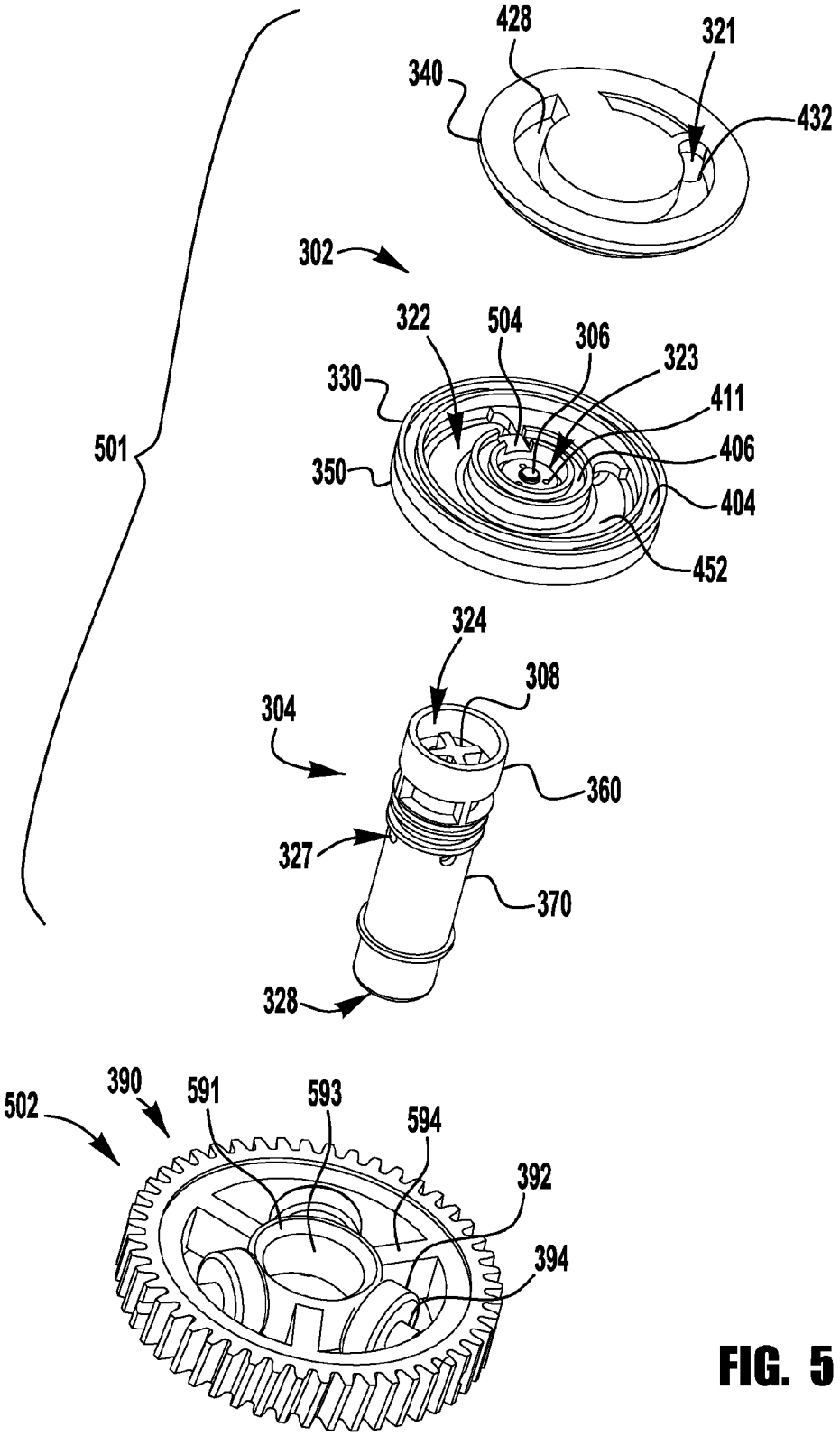
FIG. 5 is a top isometric exploded view of liquid pump 302, nozzle assembly 304, and actuation assembly 390 of FIG. 3.
Figure 6:
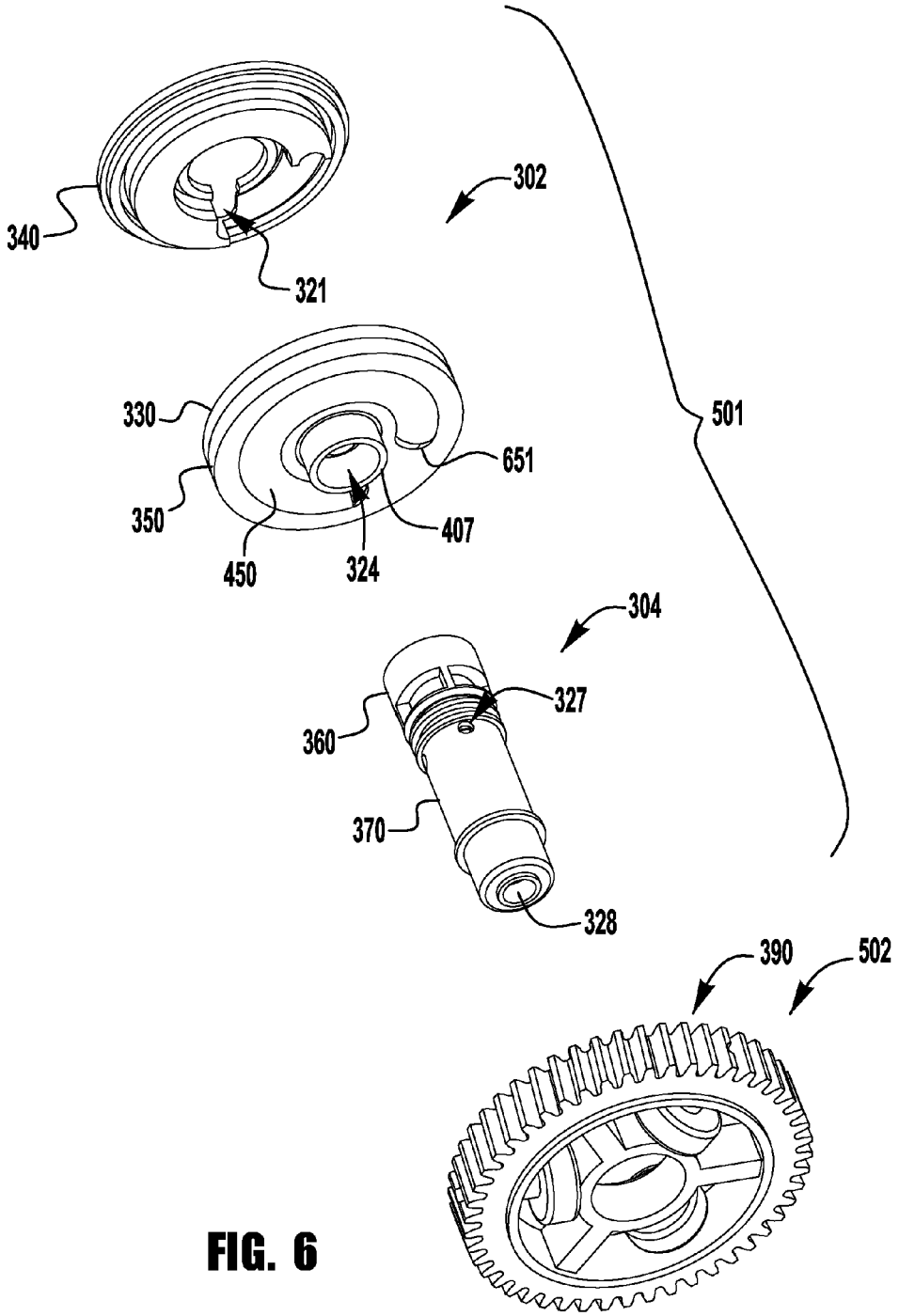
FIG. 6 is a bottom isometric exploded view of liquid pump 302, nozzle assembly 304, and actuation assembly 390 of FIG. 3.

As shown in FIG. 4, which illustrates the pump 302 and nozzle 304, the body 330 of the liquid pump 302 has a top side 401 and a bottom side 402. The top side 401 of the body 330 includes an outer annular groove 404 and an inner annular groove 406. The bottom side 402 includes an outer annular groove 414 and an inner annular groove 416. A semi-annular opening 408 is disposed radially between the outer annular grooves 404, 414 and the inner annular grooves 406, 416, and extends from the top side 401 to the bottom side 402 of the body 330. An annular projection 407A on the bottom side 402 forms a pump outlet 407 that connects to the nozzle assembly 304.

An outlet valve plate 410 includes an opening 417 and supports a one-way outlet valve 306. The outlet valve 306 may be any kind of one-way valve, such as, for example, a ball and spring valve, a poppet valve, a flapper valve, an umbrella valve, a slit valve, a mushroom valve, a duck bill valve, or the like. The outlet valve 306 prevents liquid from leaking out of the refill unit 310 during storage in embodiments where a roller 392 does not always seal membrane 450 against the bottom surface 429 of the back plate 340, or at an undesired time. A cap may optionally be assembled to the nozzle assembly 304 during storage of the refill unit 310 to prevent leakage.

The back plate 340 of the liquid pump 302 has a top side 421 and a bottom side 422. The bottom side 422 includes an outer annular projection 424 that mates with the body 330 and an inner annular projection 426 that mates with the body 330. A horseshoe shaped semi-annular projection 428 is disposed radially between the inner and outer annular projections 424, 426 and extends into the semi-annular opening 408 in the body 330 and is flush with the bottom side 402 of the body 330 when the back plate 340 and body 330 are assembled together. In some embodiments, a corresponding semi-annular groove 430 extends from the top side 421 of the back plate 340 into the semi-annular projection 428 to reduce the material required to manufacture the back plate 340. An inlet opening 432 extends from the top side 421 of the back plate 340 through the semi-annular projection 428 to form a pump inlet 321 that allows foamable liquid to flow from the reservoir 320 into the liquid pump 302. In some embodiments, the back plate 340 is made of thermoplastic elastomer ("TPE"), rubber, vinyl, or the like.

The flexible actuation membrane 350 of the liquid pump 302 has a top side 441, a bottom side 442, and a central opening 449. The top side 421 includes an outer annular projection 444 and an inner annular projection 446. The bottom side 442 includes a horseshoe shaped semi-annular resilient actuation portion 450 that projects downward from the membrane 350, and the top side 421 includes a corresponding semi-annular groove 452.

The ends 651 (FIG. 6) of the semi-annular actuation portion 450 are rounded and or tapered to provide a smooth transition for the rollers 392 of the actuation assembly 390 during actuation of the liquid pump 302. The actuation membrane 350 may be made of any suitable flexible material, such as, for example, latex rubber, polyisoprene, TPE, silicone, EPDM rubber, nitrile rubber, or the like.

The annular grooves and projections of the body 330, back plate 340, and membrane 350 provide liquid tight seals between each of these components when they are assembled to form the liquid pump 302. The outer annular groove 404 in the top side 401 of the body 330 receives the outer annular projection 424 on the bottom side 422 of the back plate 340. The inner annular groove 406 in the top side 401 of the body 330 receives the inner annular projection 426 on the bottom side 422 of the back plate 340. The outer annular groove 414 in the bottom side 401 of the body 330 receives the outer annular projection 444 on the top side 422 of the flexible actuation membrane 350. The inner annular groove 416 in the bottom side 401 of the body 330 receives the inner annular projection 446 on the top side 422 of the actuation membrane 350.

The body 330, back plate 340, and actuation membrane 350 of the liquid pump 302 are held together by being compressed between the retaining collar 316 and the neck 314 of the container 312, however, they may be held together by any means, such as, for example, an adhesive connection, a welded connection, external pressure, fastener connections, or the like, and any combination of the above.

The nozzle assembly 304 includes a nozzle 360 and a foaming outlet 370. During operation of the dispenser 300, foamable liquid is pumped through the liquid pump 302, through apertures 411, past one-way check valve 306, and into the nozzle assembly 304 to be mixed with air to generate foam. The nozzle 360 of nozzle assemble 304 has an upper end 461, a lower end 462, and a central bore 464 that extends through the nozzle 360 from the upper end 461 to the lower end 462. A counter bore 467 in the upper end 461 is configured to receive the pump outlet 407 to connect the liquid pump 302 and the nozzle assembly 304. The nozzle assembly 304 may be connected to the liquid pump 302 by any means, such as, for example, a threaded connection, a welded connection, an adhesive connection, a snap fit connection, a quarter turn connection, a friction fit connection, or the like.

The upper end 461 of the nozzle 460 has a larger diameter than the lower end 461. The larger diameter of the upper end 461 transitions to the smaller diameter of the lower end 462 at a shoulder 463. The lower end 462 of the nozzle 360 includes an annular groove 468 on its outer surface 465. One or more air inlet openings 466 are disposed within the annular groove 468. As described below, the groove 468 permits foaming outlet 370 to be connected without regard to the orientation of air inlet openings 466, 475. The annular groove 468 and the air inlet openings 466 form a nozzle air inlet 327. A shoulder 469 in the central bore 464 above the air inlet openings 466 provides support for components of the outlet valve, if required by the outlet valve such as, for example, if a spring and ball outlet valve (not shown) is used. In the illustrated embodiment, an outlet valve support 308 is disposed within the central bore 464 on the shoulder 469 to support a spring (not shown) that is part of the outlet valve 306.

The foaming outlet 370 has an upper end 471, a lower end 472, an outer surface 473, and a central bore 474. The lower end 462 of the nozzle 360 is received by the central bore 474 of the foaming outlet 370 so that the foaming outlet 370 fits like a sheath over the lower end 462 of the nozzle 360. The foaming outlet 370 may be connected to the nozzle 360 by any means, such as, for example, a threaded connection, a welded connection, an adhesive connection, a snap fit connection, a friction fit connection, a quarter turn connection, or the like.

One or more air inlet openings 475 through the foaming outlet 370 allow air to pass through the foaming outlet 370 to the nozzle 360. The upper end 471 of the foaming outlet 370 engages the shoulder 463 of the nozzle 360 to properly align the air inlet openings 475 of the foaming outlet 370 and the air inlet passageway 327 of the nozzle 360 vertically. The groove 468 eliminates the need for rotational alignment.

An annular groove 477 in the outer surface 473 above the air inlet openings 475 is configured to receive a nozzle sealing member 377, such as, for example, an O-ring. An annular ridge 476 on the outer surface 473 below the air inlet openings 475 is configured to retain a base sealing member 387, such as, for example, an O-ring, when the nozzle assembly 304 is inserted into the base 380 because the refill unit 310 is installed in the dispenser 300.

The lower end 472 of the foaming outlet 370 extends beyond the lower end 462 of the nozzle 360 to provide room for a foaming media 379. A lip 479 in the lower end 471 retains the foaming media 379 within foaming outlet 370. An opening 478 in the lower end 472 of the foaming outlet 370 forms a nozzle outlet 328 that allows foam to exit the nozzle assembly 304. The foaming media 379 may be one or more screens, porous members, baffles, a sponge, a foaming cartridge, or the like. The foaming media 379 may be an integral part with the foaming outlet 370 or may be a separate part.

The components of the liquid pump 302 and nozzle assembly 304 form various chambers when assembled. A horseshoe shaped semi-annular pump chamber 322 is formed between the bottom surface 432 of the projection 428 of the back plate 340 and the horseshoe shaped semi-annular groove 452 of the actuation membrane 350. A pump outlet chamber 323 is formed between the back plate 340 and the portion of the central bore 417 in the body 330 that is above the outlet valve 306 and outlet valve plate 410. The pump chamber 322 is connected to the pump outlet chamber 323 by an outlet channel 504 (FIG. 5) in the top side 401 of the pump body 330. A premix chamber 324 is enclosed by the portion of the central bore 417 of the body 330 below the outlet valve 306 and outlet valve plate 410, and the central bore 464 of the nozzle 360.

In the illustrated embodiment of FIG. 3, the air pump (not shown) and liquid pump 320 are arranged in a split pump configuration. The air pump (not shown), base 380, and actuation assembly 390 are secured to the dispenser 300 and are not removed when the dispenser 300 is refilled. The liquid pump 320 is included in the refill unit 310. The base 380 provides an interface between the air pump 330 and liquid pump 320 to facilitate proper operation of the split foam pump. The base 380 has a top side 381, a bottom side 382, an outer surface 383, and a central bore 384 configured to receive the nozzle assembly 304 of the refill unit 310. The central bore 384 extends through the base 380 from the top side 381 to the bottom side 382. An air inlet opening 385 extends from the outer surface 383 to the central bore 384 to form an air inlet passageway 325. A one-way valve (not shown) may optionally be included in the air inlet opening 385 to prevent back flow of fluid if the outlet of the refill unit 310 becomes clogged or if liquid travels out of air inlet 327. A lip 386 protrudes into the central bore 384 near the bottom 382 of the base 380 to retain the base sealing member 387 within the central bore 384.

Figure 7A:
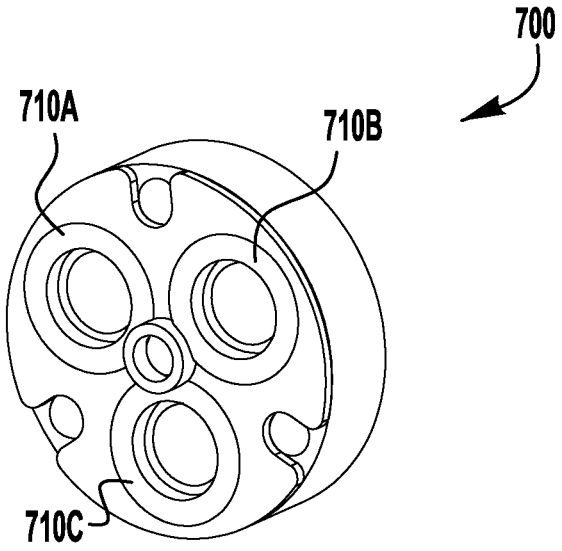
FIGS. 7A and 7B illustrate an exemplary diaphragm air pump 130.
Figure 7B:
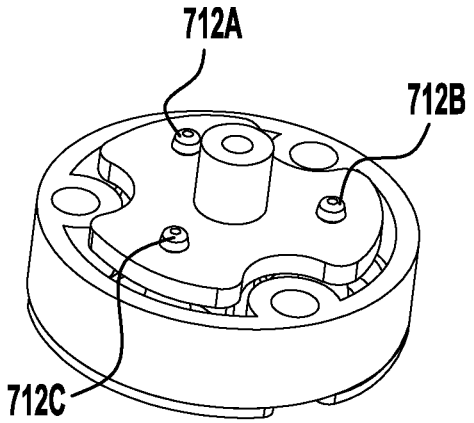

FIGS. 7A and 7B illustrate an embodiment of a diaphragm air pump 700 that may be used in connection with any of the embodiments described herein. Air pump 700 includes three diaphragms 710A, 710B, and 710C. On the back side of diaphragms 710A, 710B, and 710C are projections 712A, 712B, and 712C, respectively. During operation, diaphragm air pump 700 is connected to the back of a motor by, for example, a cylindrical adaptor (not shown). In one embodiment, the cylindrical adaptor facilitates connecting a projecting member (not shown) to the motor shaft. As the shaft rotates, the projecting member rotates and strikes projections 712A, 712B, and 712C causing the diaphragms 710A, 710B, and 710C to collapse inward and send a pulse of air out of an outlet (not shown).

When the refill unit 310 is installed in the dispenser 300, the foaming outlet 370 of the nozzle assembly 304 is inserted through the center hub 593 of the actuation assembly 390 and through the central bore 384 of the base 380. The nozzle sealing member 377 in the annular groove 374 of the foaming outlet 370 and the base sealing member 387 in the central bore 384 of the base 380 engage the wall of bore 384 and form air-tight seals between the foaming outlet 370 and the base 380.

An annular air pump interface chamber 326 is thereby formed between the central bore 384 of the base 380, the outer surface 473 of foaming outlet 370, and the sealing members 377, 387. The air pump interface chamber 326 is in fluid communication with the air inlet passageway 325 of the base 380 and the nozzle air inlet passageway 327 of the nozzle 360, allowing air provided by an air pump (not shown) to be pumped into nozzle assembly 304 regardless of the orientation of the refill unit 310 when it is installed in the dispenser 300. The sealing members 377, 387 may be any kind of suitable seal, including, for example, o-rings, elastomeric washers, integrally molded wiper seals, or a lubricant, such as, for example, grease. The refill unit 310 is secured to dispenser 300 by a releasable locking mechanism (not shown), such as, for example, a releasable locking ring.

The actuation assembly 390 includes a carriage 391 and one or more rollers 392. The carriage 391 includes a drive gear 591 that is connected by one or more spokes 592 to a central hub 593. The central hub 593 includes a central bore 594 that is configured to receive the upper end 461 of the nozzle 360. The one or more rollers 392 are disposed between the spokes 592 connecting the drive gear 591 and central hub 593. Each roller 392 is rotatably assembled to the carriage 391 on a pin 396. The rollers 392 include a spacer 394 to align the rollers 392 with the actuation portion 450 of the flexible actuation membrane 350 of the liquid pump 302. The carriage 391 and rollers 392 are formed of acetal resin, or any other suitable material. The pins 396 are stainless steel pins, but may be made from any other suitably rigid material.

The actuation assembly 390 is disposed between the base 380 and the refill unit 310. A thrust washer (not shown), or any other friction reducing device or substance, may be installed or introduced between the base 380 and the actuation assembly 390 to facilitate smooth rotation between the two components. An annular groove 388 in the top side 381 of the base 380 may also be included to provide clearance for the rollers 392 of the actuation assembly 390.

When the refill unit 310 is installed in the dispenser 300 the rollers 392 of the actuation assembly 390 compress the actuation portion 450 of the flexible actuation membrane 350, and therefore, the pump chamber 322. During operation of the dispenser 300, an actuator (for example, the actuator shown in FIG. 2) engages the drive gear 591 of the actuation assembly 390, causing it to rotate. As the actuation assembly 390 is rotated, the rollers 392 progressively compress the actuation portion 450 of the pump membrane 350 causing liquid in the pump chamber 322 to be forced through the outlet channel 504 into the pump outlet chamber 323. The actuation portion 450 of the membrane 350 expands to its original uncompressed position behind each roller, causing the pump chamber 322 to increase in volume, drawing in liquid from the reservoir 320 through the pump inlet 321.

Further actuation of the liquid pump 302 forces liquid through the outlet valve 306 into the premix chamber 324. Simultaneously, the actuator causes the air pump (not shown) to pump air into the air inlet passageway 325 of the base 380. The air flows from the air inlet passageway 325 through the pump interface chamber 326 and nozzle air inlet 327 into the premix chamber 324 to be mixed with liquid from the liquid pump 302. The air and liquid mixture is then forced through foaming media 379 to generate rich foam that is dispensed through the nozzle outlet 328. In the dispenser 300, air is pumped from the air pump (not shown) to provide an air to liquid ratio of between about 1 to 1 and about 20 to 1.

Actuation of the liquid pump 302 by a continuous rotational motion of the actuation assembly 390 provides many benefits. For example, the volume of foam dispensed from the dispenser 300 can be changed by varying the duration of the actuation cycle. This allows a single dispenser to dispense different volumes of foam for different users who request or require different volumes of foam. Sensors included in the dispenser 300 may also be used to determine the appropriate volume of foam to dispense based on the size of the user's hands and/or the dirtiness of the user's hands.

While the present invention has been illustrated by the description of embodiments thereof, and while the embodiments have been described in considerable detail, it is not the intention of the applicants to restrict or in any way limit the scope of the appended claims to such detail. Additional advantages and modifications will readily appear to those skilled in the art. Moreover, elements described with one embodiment may be readily adapted for use with other embodiments. Therefore, the invention, in its broader aspects, is not limited to the specific details, the representative apparatus and illustrative examples shown and described. Accordingly, departures may be made from such details without departing from the spirit or scope of the applicants' general inventive concept.

What is claimed is:

1. A refill unit for a foam dispenser comprising:

a container for holding a foamable liquid;

a liquid pump having a pump housing and an outlet nozzle;

the pump housing having an arcuate shaped liquid pump chamber at least partially formed by a backing plate with a liquid inlet and a flexible membrane;

wherein the outlet nozzle has an elongated central axis; and wherein at least a portion of the elongated central axis extends through an area located within the arc defined by the arcuate shaped pump chamber; and wherein the arcuate shaped liquid pump chamber is located in a plane that is perpendicular to the elongated central axis and the arcuate shaped liquid pump chamber at least partially surrounds the elongated central axis.

2. A refill unit for a foam dispenser comprising:

a container for holding a foamable liquid;

a liquid pump having a pump housing and an outlet nozzle;

the pump housing having an arcuate shaped liquid pump chamber at least partially formed by a backing plate with a liquid inlet and a flexible membrane;

wherein the outlet nozzle has an elongated central axis; and wherein at least a portion of the elongated central axis extends through area located within the arc defined by the arcuate shaped pump chamber;

wherein the backing plate comprises a horseshoe shaped arcuate recess, and wherein the liquid inlet is located proximate a first end of the arcuate recess.

3. The refill unit of claim 2 wherein the liquid passage is located at the end of the arcuate pump chamber.

4. The refill unit of claim 2 wherein the outlet nozzle extends downward from the interior portion of the pump housing.

5. The refill unit of claim 2 further comprising a liquid outlet valve located on an interior portion of the pump housing between the horseshoe shaped arcuate pump chamber and the outlet nozzle.

6. The refill unit of claim 2 wherein the horseshoe shaped arcuate pumping chamber moves fluid along a path that is substantially perpendicular to the direction of fluid that flows out of the outlet nozzle.

7. The refill unit of claim 2 wherein the outlet nozzle comprises one or more air inlet openings.

8. The refill unit of claim 2 wherein the outlet nozzle comprises one or more sealing members for sealing against a dispenser housing to create an air passage.

9. A refill unit for a foam dispenser comprising:

a container for holding a foamable liquid;

a pump housing connected to the container;

the pump housing having a base, a backing plate, a flexible membrane and an outlet nozzle;

an arcuate shaped pump chamber formed at least in part by the base, the backing plate and the flexible membrane;

a liquid inlet in the first end of the arcuate shaped pump chamber and a liquid outlet located in the second end of the arcuate shaped pump chamber;

a liquid outlet passage extending into an area that is at least partially surrounded by the arcuate shaped pump chamber;

the outlet nozzle extending from the liquid outlet passage to the outlet of the pump housing;

a foaming media located at least partially in the outlet nozzle; and one or more air inlet apertures located downstream of the liquid outlet passage and upstream of the foaming media.

10. The refill unit of claim 9 wherein fluid flowing through the arcuate shaped pump chamber flows in a plane that is substantially perpendicular to a direction of fluid flow in the outlet nozzle.

11. The refill unit of claim 9 wherein the arcuate shaped pump chamber is along a substantially horizontal axis and the outlet nozzle extends along a substantially vertical axis.

12. A refill unit for a foam dispenser comprising:

a container for holding a foamable liquid;

a liquid pump having a pump chamber and an outlet nozzle;

the pump chamber having an arcuate shape;

the pump chamber formed at least in part by a backing plate and a flexible membrane;

the pump chamber having a liquid inlet;

wherein the flexible membrane is compressed against the backing plate to pump fluid; and wherein a central axis extends through the outlet nozzle in the direction of fluid flow; and wherein the arcuate shaped pump chamber extends at least partially along a plane perpendicular to the central axis and along a selected radius extending from the central axis.

13. A refill unit for a foam dispenser comprising:

a container for holding a foamable liquid;

a liquid pump having a pump chamber and an outlet nozzle;

the pump chamber having an arcuate shape;

the pump chamber formed at least in part by a backing plate and a flexible membrane;

the pump chamber having a liquid inlet;

wherein the flexible membrane is compressed against the backing plate to pump fluid;

wherein the backing plate comprises a horseshoe shaped arcuate recess, and wherein the liquid inlet is located near a first end of the arcuate recess.

14. The refill unit of claim 13 further comprising a liquid passage between the pump chamber and an interior portion of a pump housing.

* * * * *